US010420703B1

(12) United States Patent
Lee

(10) Patent No.: US 10,420,703 B1
(45) Date of Patent: Sep. 24, 2019

(54) PILL CONTAINER

(71) Applicant: E-LINK PLASTIC & METAL INDUSTRIAL CO., LTD., New Taipei (TW)

(72) Inventor: Cheng-Hua Lee, New Taipei (TW)

(73) Assignee: E-LINK PLASTIC & METAL INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 16/137,511

(22) Filed: Sep. 20, 2018

(51) Int. Cl.
*B65D 83/04* (2006.01)
*A61J 1/03* (2006.01)

(52) U.S. Cl.
CPC ..... *A61J 1/03* (2013.01)

(58) Field of Classification Search
CPC ..... B65D 75/327; B65D 83/04; A61J 1/03
USPC ..... 206/1.5, 528, 530, 533, 534, 538, 539, 206/540, 804; 220/23.8
See application file for complete search history.

(56) References Cited

U.S. PATENT DOCUMENTS 4,372,445 A * 2/1983 Keffeler ..... B65D 21/0204 206/532
4,793,492 A * 12/1988 Halbich ..... A45C 11/24 206/538
7,624,890 B2 * 12/2009 Noble ..... A61J 7/04 206/538
7,793,785 B2 * 9/2010 Keffeler ..... A61J 1/03 206/532
7,798,330 B2 * 9/2010 Noble ..... B65D 83/04 206/1.5
8,146,627 B2 * 4/2012 Mazur ..... A61J 1/03 141/240
9,066,849 B2 * 6/2015 Fung ..... A61J 1/03

* cited by examiner

*Primary Examiner* — Luan K Bui
(74) *Attorney, Agent, or Firm* — Hershkovitz & Associates, PLLC; Abe Hershkovitz

(57) ABSTRACT

A pill container has a body, multiple lids, and multiple resilient pushing bars. The body has a front wall, a rear wall, multiple compartments, and multiple locking buttons. The locking button are formed on the front wall of the body and aligned respectively with the compartments. The lids are connected pivotally to the rear wall of the body to selectively close the compartments respectively and are engaged detachably with the locking buttons respectively. Each lid has an inner surface facing a corresponding one of the compartments of the body. The resilient pushing bars are mounted on the rear wall of the body and respectively abut against the inner surfaces of the lids.

7 Claims, 7 Drawing Sheets

PILL CONTAINER

BACKGROUND OF THE INVENTION

1. Field of the Invention

The present invention relates to a pill container, and more particularly to a lockable pill container.

2. Description of Related Art

A pill container is applied to hold pills, such as medicines or vitamins for a user to take pills regularly. A conventional pill container substantially comprises a body and multiple lids. The body has multiple compartments formed in the body for holding pills inside. The lids are integrally connected with the body to close the compartments. A lock means is provided between the body and each lid. When the lock means is unlocked, the lid can be opened relative to the body, and the pills can be taken out of the corresponding compartment.

However, the lids of the conventional pill container are integrally connected with the body. When the lids are in a closed position to close the compartment, the lids are deformed and bent. When the lock means is unlocked, the lid is opened automatically due to the force generated by the deformation of the lid. Accordingly, the lid cannot be completely opened, and the opening angle of the lid relative to the body is not sufficient. Consequently, to take the pills out from the compartment is inconvenient. In addition, the lids are easily damaged because the lids are always deformed and bent for a long time at the closed position.

To overcome the shortcomings, the present invention tends to provide a pill container to mitigate or obviate the aforementioned problems.

SUMMARY OF THE INVENTION

The main objective of the invention is to provide a pill container to allow lids to be opened completely.

The pill container has a body, multiple lids, and multiple resilient pushing bars. The body has a front wall, a rear wall opposite the front wall, multiple compartments, and multiple locking buttons. The compartments are formed in the body. The locking buttons are formed on the front wall of the body and aligned respectively with the compartments. The lids are connected pivotally to the rear wall of the body to selectively close the compartments respectively and are engaged detachably with the locking buttons respectively. Each lid has an inner surface facing a corresponding one of the compartments of the body. The resilient pushing bars are mounted on the rear wall of the body and respectively abut against the inner surfaces of the lids. The body further has multiple insertion sockets formed on the rear wall of the body. Each resilient pushing bar has a bottom end inserted into a respective one of the insertion sockets in the body.

Other objects, advantages and novel features of the invention will become more apparent from the following detailed description when taken in conjunction with the accompanying drawings.

DETAILED DESCRIPTION OF PREFERRED EMBODIMENT

Figure 1:
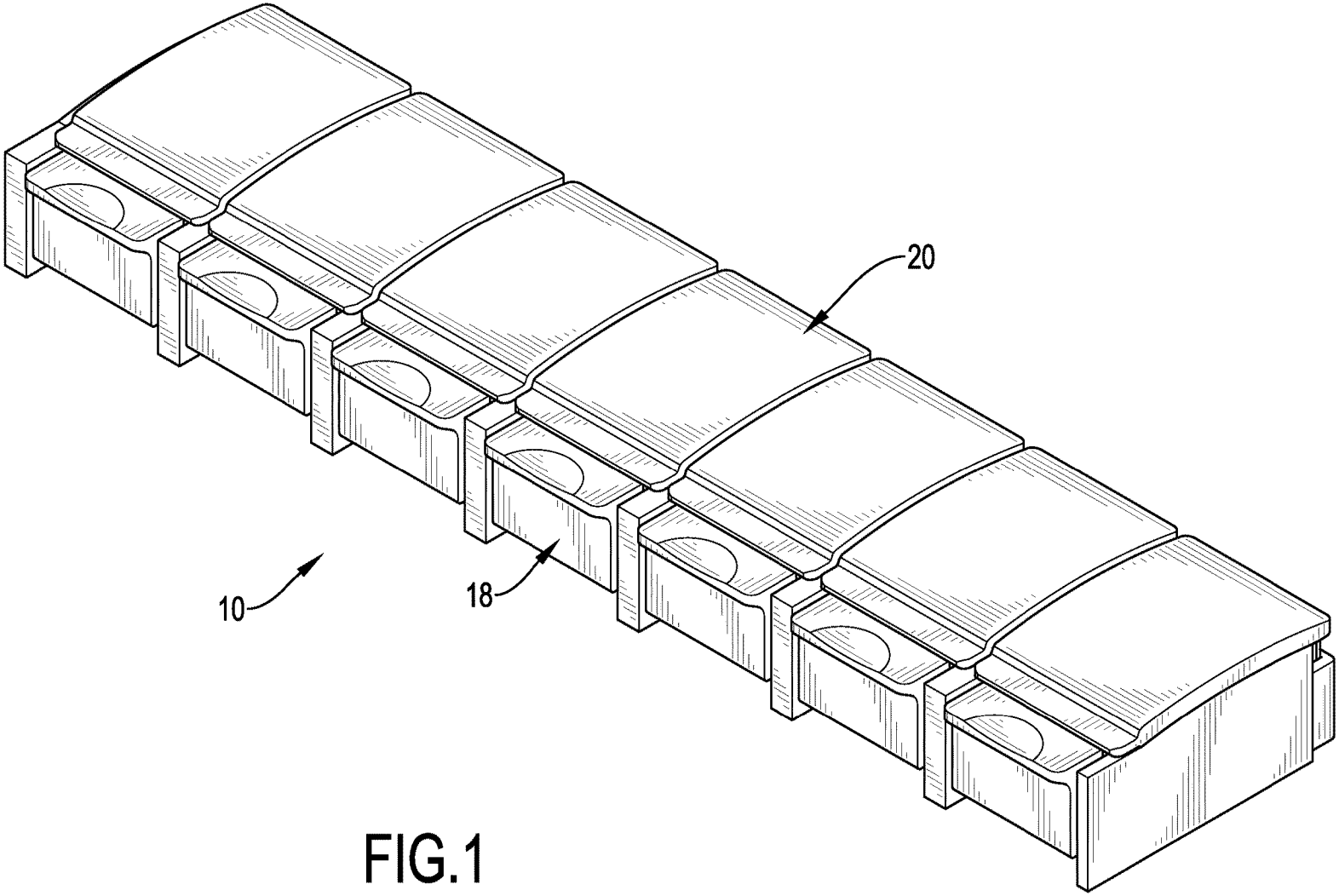
FIG. 1 is a perspective view of a pill container in accordance with the present invention.
Figure 2:
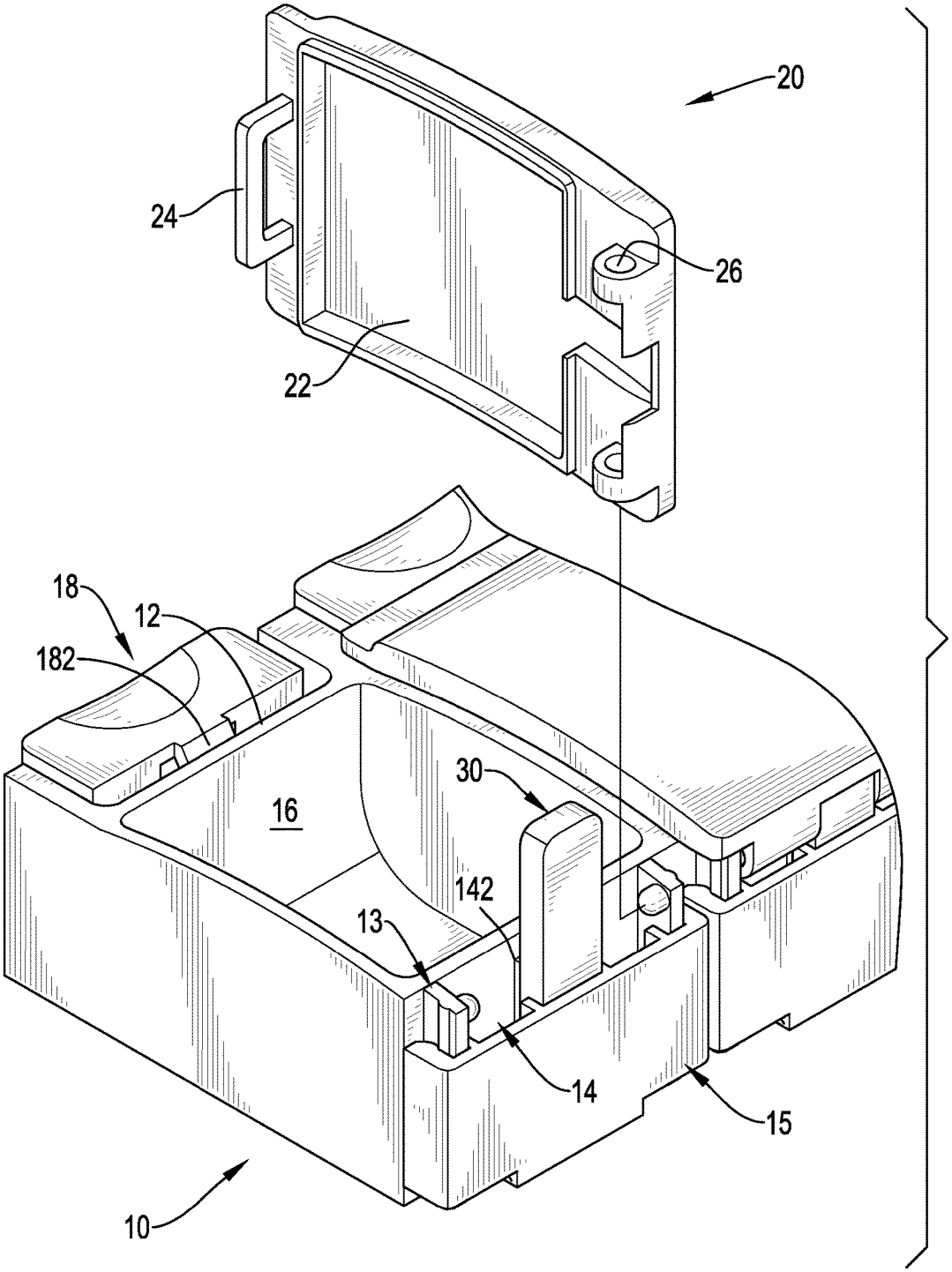
FIG. 2 is an enlarged exploded perspective view of the pill container in FIG. 1.
Figure 3:
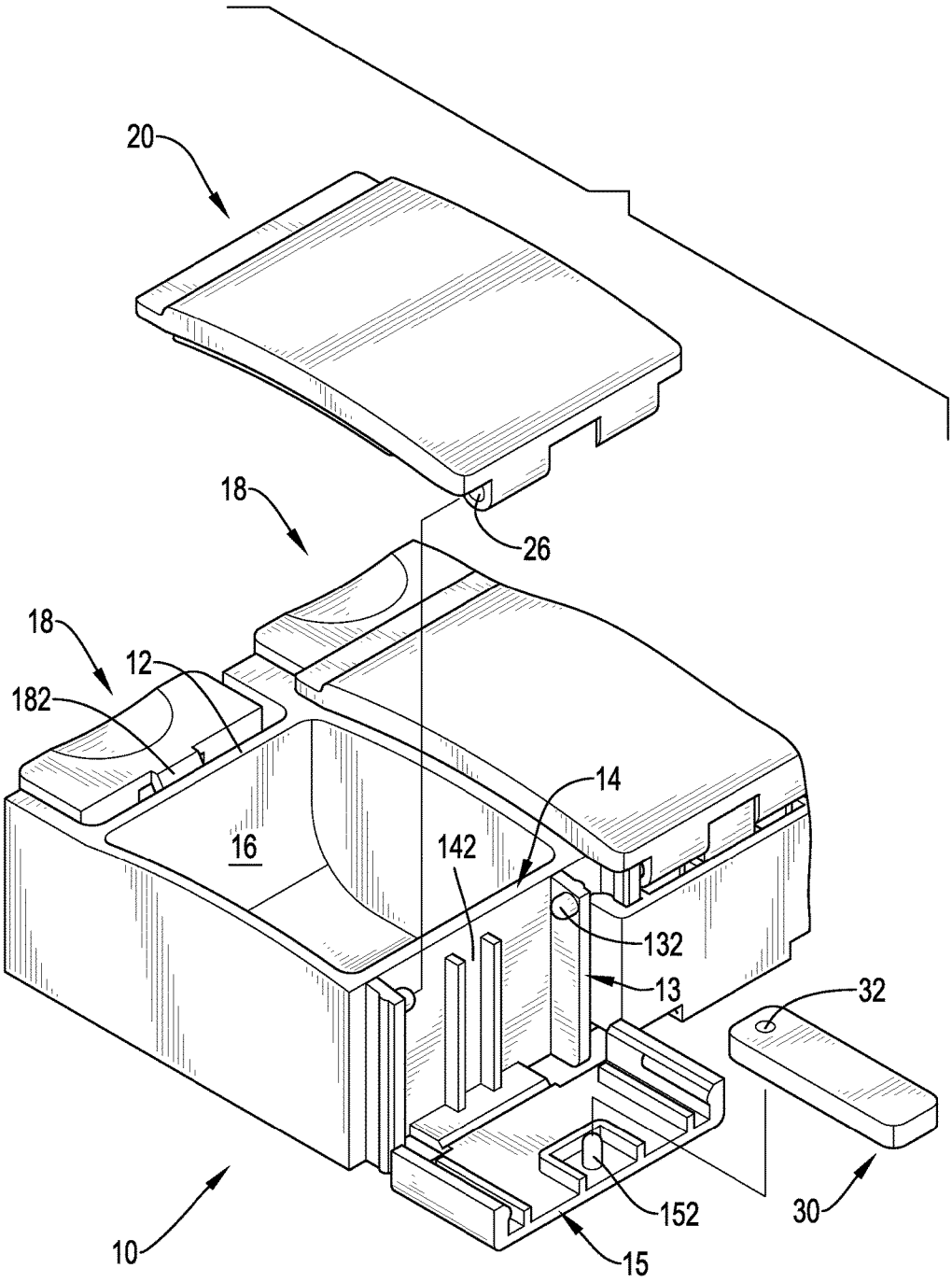
FIG. 3 is another enlarged exploded perspective view of the pill container in FIG. 1.
Figure 4:
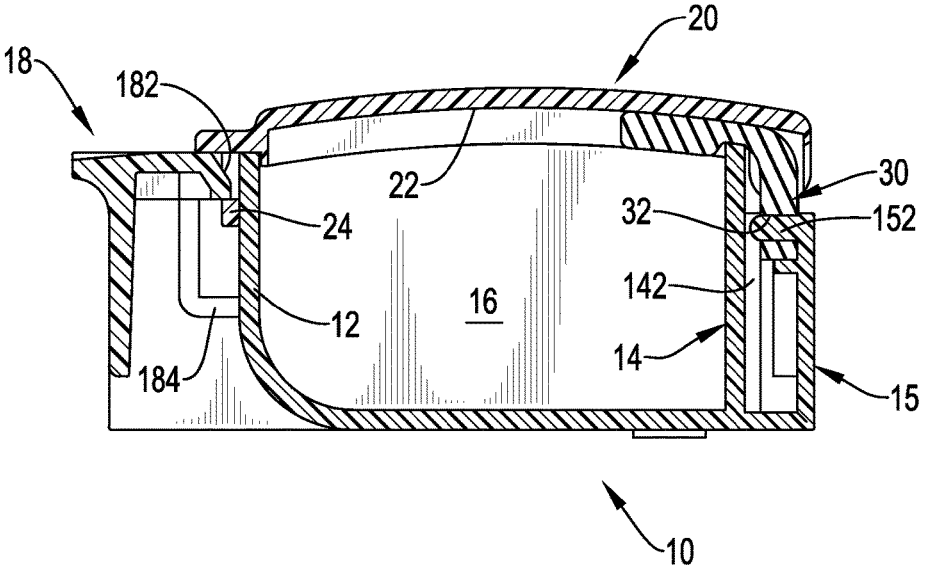
FIG. 4 is an enlarged cross sectional side view of the pill container in FIG. 1.

With reference to FIGS. 1 to 4, a pill container in accordance with the present invention comprises a body 10, multiple lids 20, and multiple resilient pushing bars 30.

The body 10 may be elongated and has a front wall 12, a rear wall 14, multiple compartments 16, and multiple locking buttons 18. The compartments 16 are defined in the body 10 to hold pills inside. The locking buttons 18 are formed on the front wall 12 of the body 10 and are aligned respectively with the compartments 16. Each locking button 18 has a connecting segment 184 formed on a bottom end of the locking button 18 and connected integrally with the front wall 12 of the body 10 to define a gap between the front wall 12 and the locking button 18. In addition, each locking button 18 has a locking block 182 formed on and protruding from the locking button 18. The locking block 182 extends into the gap between the front wall 12 and the locking button 18.

The lids 20 are connected pivotally to the rear wall 14 of the body 10 to selectively close the compartments 16 respectively and are engaged detachably with the locking buttons 18 respectively. Each lid 20 has an inner surface 22 and a locking loop 24. The inner surface 22 faces a corresponding one of the compartments 16 of the body 10. The locking loop 24 is formed on and protrudes from the inner surface 22 of the lid 20 at an end of the lid 20 opposite the rear wall 14 of the body 10 to selectively engage with the locking block 182 on a corresponding locking button 18.

To pivotally connect each lid 20 to the rear wall 14 of the body 10, the body 10 further has multiple pairs of pivotal tabs 13 formed on the rear wall 14 of the body 10. Each pair of pivotal tabs 13 includes two pivotal tabs 13 being parallel with each other. Each pivotal tab 13 of each pair of pivotal tabs 13 has a pivotal axle 132 formed on and protruding from the pivotal tab 13 and aligned with the pivotal axle 132 on the other pivotal tab 13. Each lid 20 has two pivotal holes 26 defined in the lid 20 and mounted rotatably around the pivotal axles 132 on the pivotal tabs 13 of a corresponding one of the pairs of pivotal tabs 13. Accordingly, the lids 20 can be pivoted relative to and detached from the rear wall 14 of the body 10.

The resilient pushing bars 30 are mounted on the rear wall 14 of the body 10 and respectively abut against the inner surfaces 22 of the lids 20. Preferably, the pushing bars 30 are made of silicone. In addition, the body 10 further has multiple insertion sockets 142 formed on the rear wall 14 of the body 10, and each resilient pushing bar 30 has a bottom end inserted into a respective one of the insertion sockets 142 in the body 10. Moreover, the body 10 may further have multiple rear caps 15 pivotally mounted on the rear wall 14 of the body 10 to respectively close the insertion sockets 142. Each pushing bar 30 has a positioning hole 32 defined through the pushing bar 30 at a positon near the bottom end.

Each rear cap 15 has a positioning pin 152 formed on and protruding from the rear cap 15 and inserted into a positioning hole 32 of a corresponding resilient pushing bar 30. Accordingly, the resilient pushing bars 30 can be securely mounted on the rear wall 14 of the body 10.

With such a pill container, pills, such as medicines or vitamins, can be stored in the compartments 16 in the body 10 to allow a user to take the pills regularly. With the engagement between the locking blocks 182 on the locking buttons 18 with the locking loops 24 on the lids 20, the lids 20 can be held at a closed position. At the closed position, the locking loops 24 on the lids 20 extend into the gaps between the front wall 12 and the locking buttons 18, and the resilient pushing bars 30 are respectively pushed against by the inner surfaces 22 of the lids 20 and are bent.

Figure 5:
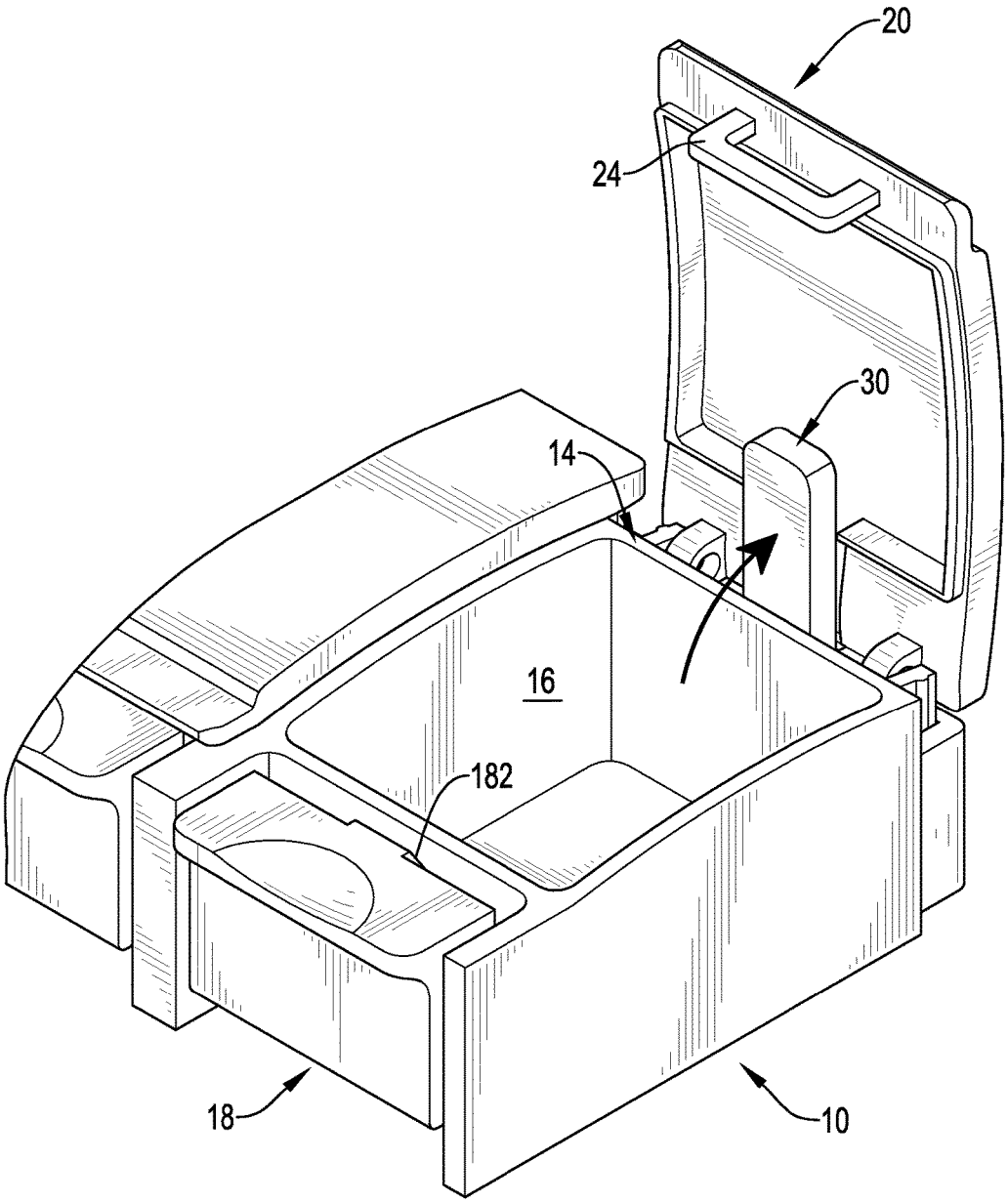
FIG. 5 is an enlarged operational perspective view of the pill container in FIG. 1 showing one lid being opened.
Figure 6:
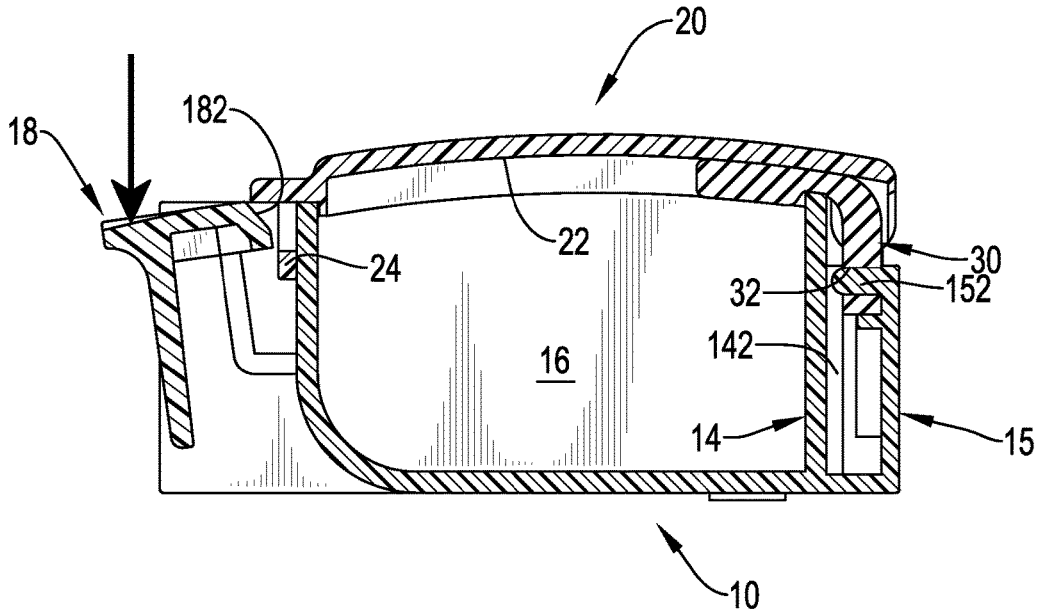
FIG. 6 is an enlarged operational cross sectional side view of the pill container in FIG. 1 showing one locking button being pushed.
Figure 7:
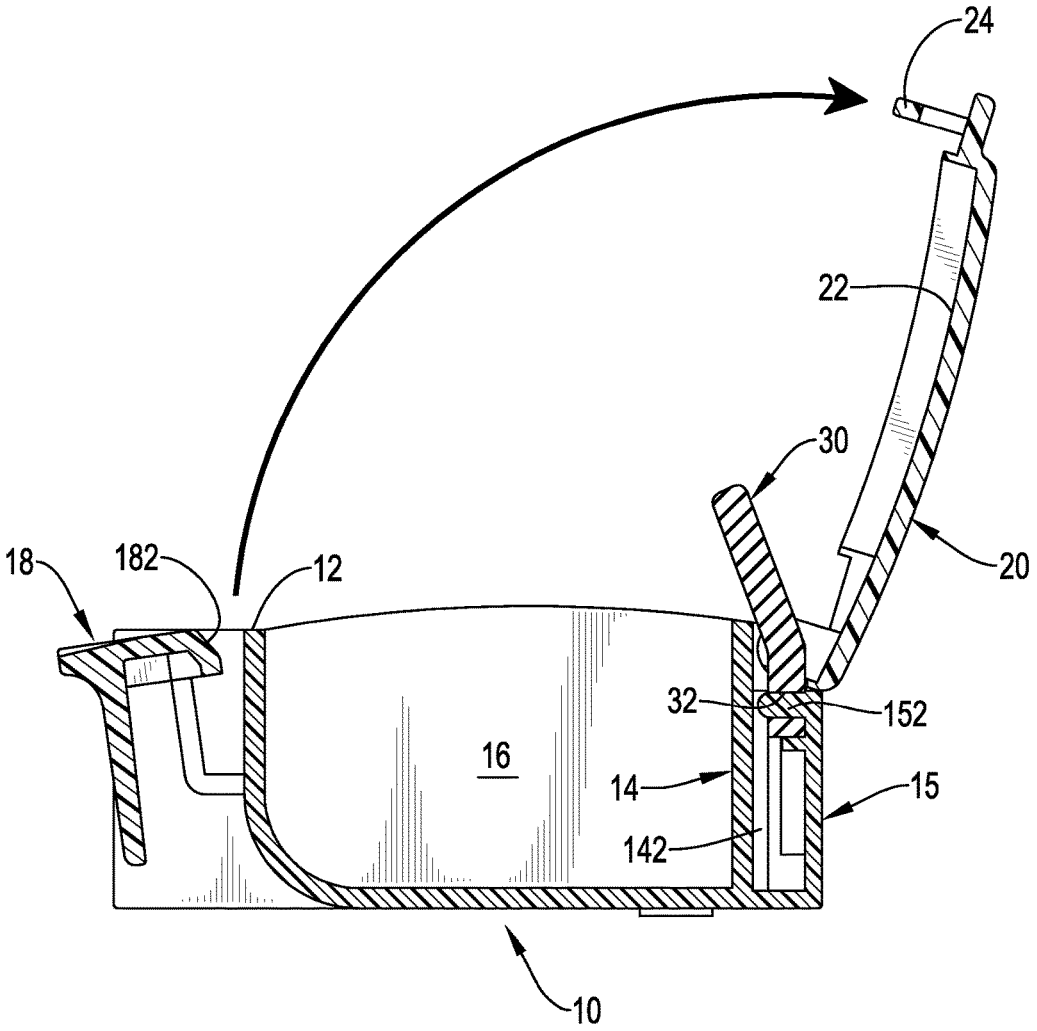
FIG. 7 is an enlarged operational cross sectional side view of the pill container in FIG. 1 showing one lid being opened.

With reference to FIGS. 5 to 7, to open any one of the lids 20, a corresponding locking button 18 is pushed. When the locking button 18 is pushed, the locking block 182 on the locking button 18 is disengaged from the locking loop 24 on the corresponding lid 20, and the lid 20 will be automatically pivoted relative to the rear wall 14 of the body 10 by the resilient force provided by the bent pushing bar 30. Accordingly, the resilient pushing bar 30 can provide the lid 20 with a sufficient force to completely open the lid 20 relative to the rear wall 14 of the body 10. Thus, a user can take the pills held in the compartment 16 easily and conveniently. Additionally, the lids 20 can be kept from being deformed or bent at the closed position, such that the lids 20 are not easily damaged after a long time of use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pill container comprising:

a body having a front wall;

a rear wall opposite the front wall;

multiple compartments formed in the body; and multiple locking buttons formed on the front wall of the body and aligned respectively with the compartments;

multiple lids connected pivotally to the rear wall of the body to selectively close the compartments respectively and engaged detachably with the locking buttons respectively, and each lid having an inner surface facing a corresponding one of the compartments of the body; and multiple resilient pushing bars mounted on the rear wall of the body and respectively abutting against the inner surfaces of the lids, wherein the body further has multiple insertion sockets formed on the rear wall of the body; and each resilient pushing bar has a bottom end inserted into a respective one of the insertion sockets in the body.

2. The pill container as claimed in claim 1, wherein each lid has a locking loop formed on and protruding from the inner surface of the lid at an end of the lid opposite the rear wall of the body; and each locking button on the body has a locking block formed on and protruding from the locking button and selectively engaged with the locking loop on a corresponding one of the lids.

3. The pill container as claimed in claim 2, wherein each locking button has a connecting segment formed on a bottom end of the locking button and connected integrally with the front wall of the body to define a gap between the front wall and the locking button.

4. The pill container as claimed in claim 3, wherein the body further has multiple pairs of pivotal tabs formed on the rear wall of the body;

each pair of pivotal tabs includes two pivotal tabs being parallel with each other, and each pivotal tab of each pair of pivotal tabs has a pivotal axle formed on and protruding from the pivotal tab and aligned with the pivotal axle on the other pivotal tab of the pair of pivotal tabs; and each lid has two pivotal holes defined in the lid and mounted rotatably around the pivotal axles on the pivotal tabs of a corresponding one of the pairs of pivotal tabs.

5. The pill container as claimed in claim 1, wherein each locking button has a connecting segment formed on a bottom end of the locking button and connected integrally with the front wall of the body to define a gap between the front wall and the locking button.

6. The pill container as claimed in claim 5, wherein the body further has multiple pairs of pivotal tabs formed on the rear wall of the body;

each pair of pivotal tabs includes two pivotal tabs being parallel with each other, and each pivotal tab of each pair of pivotal tabs has a pivotal axle formed on and protruding from the pivotal tab and aligned with the pivotal axle on the other pivotal tab of the pair of pivotal tabs; and each lid has two pivotal holes defined in the lid and mounted rotatably around the pivotal axles on the pivotal tabs of a corresponding one of the pairs of pivotal tabs.

7. The pill container as claimed in claim 1, wherein the body further has multiple pairs of pivotal tabs formed on the rear wall of the body;

each pair of pivotal tabs includes two pivotal tabs being parallel with each other, and each pivotal tab of each pair of pivotal tabs has a pivotal axle formed on and protruding from the pivotal tab and aligned with the pivotal axle on the other pivotal tab of the pair of pivotal tabs; and each lid has two pivotal holes defined in the lid and mounted rotatably around the pivotal axles on the pivotal tabs of a corresponding one of the pairs of pivotal tabs.

* * * * *